US005722356A

United States Patent [19]

Hara

[11] Patent Number: 5,722,356

[45] Date of Patent: Mar. 3, 1998

[54] CAMSHAFT PHASE CHANGING DEVICE

[75] Inventor: Seinosuke Hara, Atsugi, Japan

[73] Assignee: Unisia Jecs Corporation, Atsugi, Japan

[21] Appl. No.: 694,756

[22] Filed: Aug. 9, 1996

[30] Foreign Application Priority Data

Aug. 9, 1995 [JP] Japan ..... 7-203043

[51] Int. Cl.[6] ..... F01L 1/344

[52] U.S. Cl. ..... 123/90.17; 123/90.31; 74/568 R

[58] Field of Search ..... 123/90.15, 90.17, 123/90.31; 74/568 R; 464/1, 2, 160

[56] References Cited

U.S. PATENT DOCUMENTS

| | | | |
|---|---|---|---|
| 5,033,327 | 7/1991 | Lichti et al. | 74/568 R |
| 5,058,539 | 10/1991 | Saito et al. | 123/90.17 |
| 5,088,456 | 2/1992 | Suga | 123/90.17 |
| 5,119,691 | 6/1992 | Lichti et al. | 74/568 R |
| 5,163,872 | 11/1992 | Niemiec et al. | 464/2 |
| 5,167,206 | 12/1992 | Suga | 123/90.17 |
| 5,197,421 | 3/1993 | Hara | 123/90.17 |
| 5,203,290 | 4/1993 | Tsuruta et al. | 123/90.17 |
| 5,209,193 | 5/1993 | Uchida et al. | 123/90.17 |
| 5,309,873 | 5/1994 | Suga et al. | 123/90.17 |
| 5,447,126 | 9/1995 | Kondoh et al. | 123/90.17 |

FOREIGN PATENT DOCUMENTS

| | | |
|---|---|---|
| 0 422 791 | 4/1991 | European Pat. Off. . |
| 195 09 845 | 9/1995 | Germany . |

*Primary Examiner*—Weilun Lo
*Attorney, Agent, or Firm*—Foley & Lardner

[57] ABSTRACT

A variable camshaft phase changing device comprises two axially-spaced annular gears disposed and engaged between a drive and a driven member, a plurality of coil springs compressed between the annular gears to bias one apart from the other, and an annular piston having a plurality of pins which pass through one and the other of the annular gears. The plurality of pins have heads arranged to come into driving relation with the other of the annular gears.

12 Claims, 6 Drawing Sheets

CAMSHAFT PHASE CHANGING DEVICE

BACKGROUND OF THE INVENTION

The present invention relates to a camshaft phase changing device and more particularly to a camshaft phase changing device for varying the timing of the valve actuation by an engine driven camshaft.

It is known in the art relating to engine valve gear to provide various means for varying valve timing as desired for the control of engine performance and efficiency. Among the various types of variable valve timing devices, there have been employed camshaft phase changing devices, often in the form of drive pulleys or sprockets incorporating phase changing means for varying the phase between drive and driven members. Among the pertinent prior art, there are mechanisms having splined pistons which are hydraulically actuated against a return spring to vary the phasing of outwardly and inwardly engaged drive and driven members. Such arrangements are shown for example in U.S. Pat. Nos. 5,163,872 to Niemiec et al. and 5,119,691 to Lichti et al.

Also known is a camshaft phase changing device shown in DE-A 195 09 845 which corresponds to commonly assigned co-pending U.S. patent application Ser. No. 08/406,302, now U.S. Pat. No. 5,592,909.

SUMMARY OF THE INVENTION

The present invention extends the concepts of the prior art to provide an especially effective form of phase changing device in less complicated structure with reduced number of component parts. In various embodiments, the invention is used as a variable camshaft phase changing device applied in an engine camshaft drive to vary the phase or timing of a driven camshaft relative to a drive member, such a sprocket, that is driven in timed relation to an engine crankshaft or the like.

According to the present invention, there is provided a variable camshaft phase changing device for an internal combustion engine having a camshaft rotatable about a camshaft axis, comprising:

co-axial drive and driven members, said driven member being securable to the camshaft for rotation therewith about an axis, said drive and driven members having an internal helical spline and an external helical spline, respectively, that are facing each other and have opposite helix angles;

two axially-spaced annular gears disposed and engaged between said drive and driven members, each of said annular gears having inner and outer helical splines, said inner helical splines of said annular gears mating with said external helical spline of said driven member, said outer helical splines of said annular gears mating with said internal helical spline of said drive member;

means for biasing said annular gears one apart from the other for lash take-up whereby said outer splines of said annular gears and said inner splines thereof are misaligned so that said outer splines of said annular gears engage opposite sides of said internal spline of said drive member, and said inner splines of said annular gears engage opposite sides of said external spline of said driven member;

means including an annular piston, for axially moving said annular gears in one direction and in a return direction opposite to said one direction to vary the phase relationship between said drive and driven members, said annular piston having a plurality of pins which pass through one of said annular gears to the other of said annular gears; and said plurality of pins having heads arranged in driving relation with the other of said annular gears for transmitting motion of said plurality of pins to the other of said annular gears in said one direction as said annular piston moves in said one direction, said annular piston being movable in said return direction to move the one of said annular gears in said return direction as said annular piston moves in said return direction.

DESCRIPTION OF THE PREFERRED EMBODIMENTS

Figure 1:
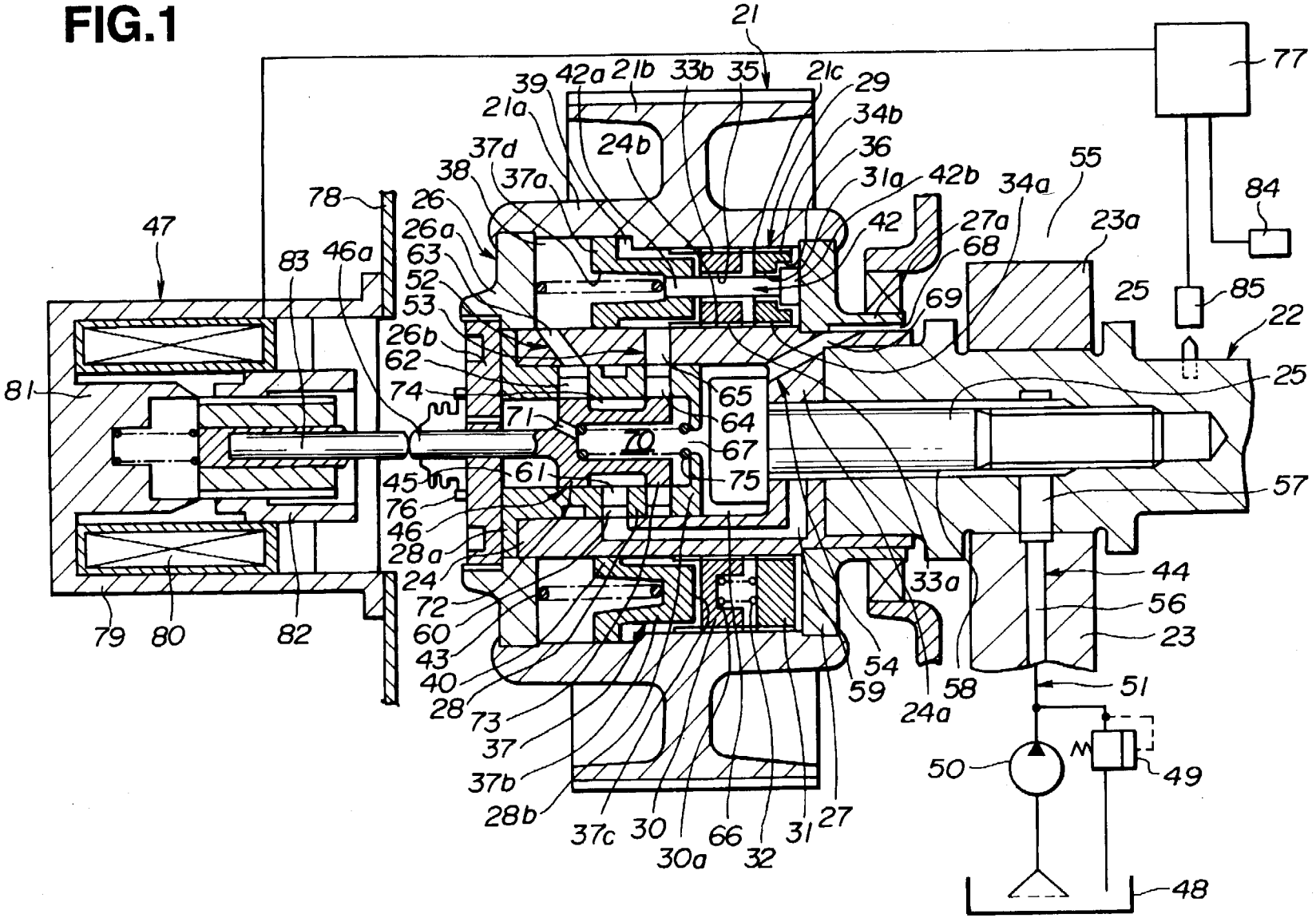
FIG. 1 is a cross-sectional view of a variable camshaft phase changing device in one extreme position with a solenoid of an actuator deenergized (i.e., off condition)

Referring to FIG. 1, there is illustrated a portion of an internal combustion engine of the type having a camshaft 22 rotatably supported on a cylinder head 23 by a cam bracket 23*a*. The camshaft 22 carries a plurality of came (not shown) for actuating the engine cylinder valves in the form of intake valves against valve springs. The engine cylinder valves may be in the form of exhaust valves.

On the front, driven, end of the camshaft 22, there is a variable camshaft phase changing device that includes a sprocket 21. The sprocket 21 comprises a wheel 21*b* that is toothed and drivingly engaged by a timing chain, not shown, for rotatably driving the sprocket 21 on an axis that is co-axial with the camshaft 22. Within the wheel 21*b* is a sleeve 21*a* including a rearwardly extending hub and a forwardly extending hub. The rearwardly extending hub is fixedly carried on the outer periphery of retainer 27 having an inner sleeve portion 27*a*. The forwardly extending hub is fixedly carried on the outer periphery of a front cover 26.

The variable camshaft phase changing device further includes a stub shaft 24. The stub shaft 24 has a central cylindrical bore closed by a partition 24*a*. Through this central cylindrical bore, the stub shaft 24 is secured at the partition 24*a* to the front end portion 22*a* of the camshaft 22 by a screw or bolt 25 to maintain fixed drive relationship with the camshaft 22. The stub shaft 24 carries for angular motion the inner periphery of the sleeve portion 27*a* of the retainer 27. At the front end portion thereof, the stub shaft 24 carries for angular motion the inner periphery of an inner peripheral portion 26*a* of the front cover 26. Fixedly fitted, with press fit, in the central cylindrical bore of the stub shaft is a cylindrical insert 28. The cylindrical insert 28 has a rear end 28*b* opposed in spaced relation to the head of the bolt 25 and a flange 28*a* radially extending outwardly from the front end portion thereof. The flange 28*a* covers and abuts the front end of the stub shaft 24.

The stub shaft 24 has an external helical spline 24*b* adjacent rear end thereof. The end portion of the stub shaft 24 formed with the external helical spline 24*b* extends within the rearwardly extending diameter thereof. The rearwardly extending hub of the sleeve 21*a* of the sprocket 21 has an internal helical spline 21*c* facing the external helical spline 24*b*. The facing splines 24*b* and 21*c* have opposite helix angles to provide for phasing action.

Between and engaging both of the splines 24*b* and 21*c* is an annular gear assembly 29. This assembly 29 includes two axially-spaced annular gears, called for convenience, a front or outer gear 30 and a rear or inner gear 31, the rear gear 31 being closer to the retainer 27. Both gears 30 and 31 have inner and outer helical splines drivingly mated with the external and internal splines 24*b* and 21*c* of the stub shaft 24 and sprocket 21, respectively. Specifically, the front gear 30 has inner and outer helical splines 33*a* and 33*b*, while the rear gear 31 has inner and outer helical splines 34*a* and 34*b*. As readily seen from FIG. 3, the inner helical splines 33*a* and 34*a* of the front and rear gears 38 and 31 mate with the external helical spline 24*b* of the stub shaft 24, while the outer helical splines 33*b* and 34*b* of both of the gears 30 and 31 mate with the internal helical spline 21*c* of the sprocket 21.

Figure 2:
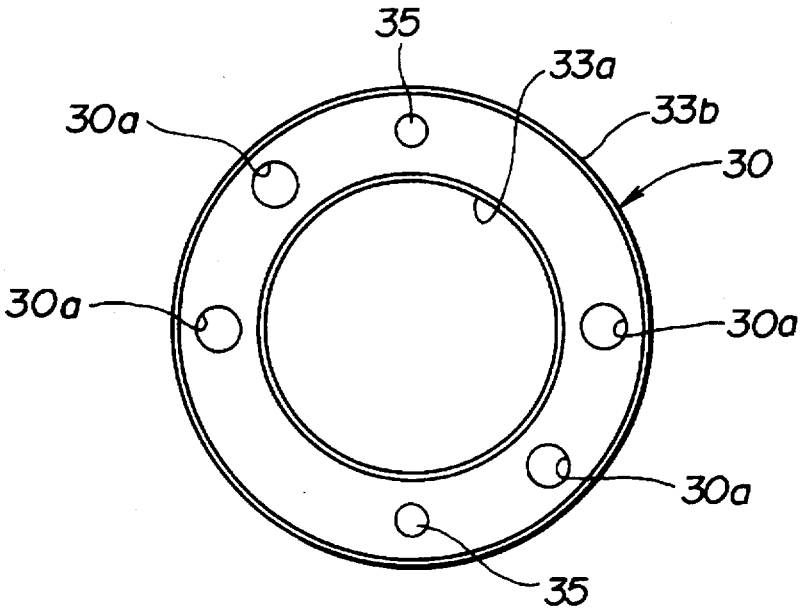
FIG. 2 is an exploded axial end view of a front one of two axially-spaced annular gears disposed and engaged between splines on co-axial drive and driven members.
Figure 3:
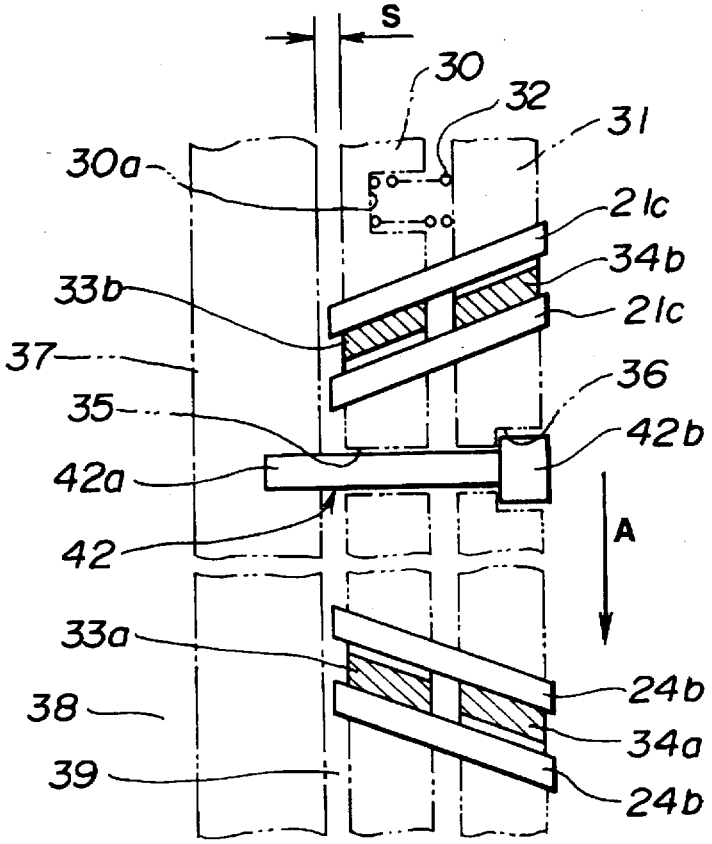
FIG. 3 is a schematic view illustrating a relationship between splines on the two-axialy spaced gears, internal helical spline of the drive member, external helical spline of the driven member, and a piston.

The front and rear gears 30 and 31 are biased apart one from another by a plurality, four in this embodment, of angularly spaced coil springs 32 compressed between the front and rear gears 30 and 31. The coil springs 32 are received in recesses 30*a* (see FIG. 2) on the rear side or inside face of the front gear 30. A plurality, two in this embodiment, of pins 42 extend through openings 35 of the front gear 30 and through the mating openings of the rear gear 31 and have heads 42*b* received in loose fit manner in recesses 36 on the far side of the gear 31. The openings of the rear gear 31 and the openings 35 of the front gear 30 are wide enough to allow the front gear 30 to move angularly relative to the rear gear 31 in a limited manner. Referring to FIG. 3, the splines of the front and rear gear 30, 31 are mis-aligned so that, when the front and rear gears 30 and 31 are urged apart one from another, the splines of the front and rear gears 30 and 31 engage opposite sides of the mated splines 21*c* and 24*b* and thus take up the lash that would otherwise occur in transferring drive torque between the sprocket 21 and stub shaft 24.

The pins 42 extend through the front gear 31 and secured at their front end portions 42*a* fixedly to an annular piston 37. The annular piston 37 is slidably disposed between the sleeve 21*a* and the stub shaft 24. The annular piston 37 includes a seal carrier 37*a* carrying at its outer periphery an outer peripheral seal and at its inner periphery an inner peripheral seal. The seal carrier 37*a* is slidably disposed between the forwardly extending cylindrical outer surface of the stub shaft 24 and the inner cylindrical surface of the forwardly extending hub of the sleeve 21*a* of the sprocket 21. The annular piston 37 includes an integral projection 37*b* extending from the seal carrier 37*a* rearwardly towards the front gear 30. The rear end 37*c* of the projection 37*b* is opposed to the front gear 30. The projection 37*b* is formed with pin holed into which the front end portion 42*a* are fixedly received. An annular recess 37*d* is cut inwardly from the front end of the seal carrier 37*a* inwardly into the projection 37*b*.

The pins 42 are fixedly secured to the annular piston 37 and extend rearwardly through the front and rear gears 30, 31 and have heads 42*b* thereof disposed within the recesses 36 formed on the outside face of the rear gear 31. The pins 41 are slidable relative to the front and rear gears 30, 31 in a limited manner.

The annular piston 37 and the seals carried the seal carrier 37*a* cooperate with the forwardly extending hub of the sleeve 21*a*, the cylindrical outer surface of the stub shaft 24 and the front cover 26 a first annular chamber 38 between the annular piston 37 and the front cover 26 and a seccond chamber 39 between the annular piston and the front gear 30.

An assist coil spring 43, disposed in the first chamber 38, has one end bearing against the front cover and extends into the annular recess 37*d*. The opposite end of the coil spring 43 bears against the axial end wall of the annular recess 37*d*. The setting is such that the coil spring 43 assists the annular piston 37 in moving toward the retainer 27.

For axially moving the annular gears 30 and in one or leftward, viewing in FIG. 1, direction to vary the phase relationship between the sprocket and stub shaft 24, oil under pressure may be supplied to the second chamber 39 with the first chamber 38 vented always. In this case, the annular piston 37 axially moves in the leftward direction against the action of the assist spring 43 in response to the oil under pressure supplied to the second chamber 39, pulling the rear gear 31 and then the front gear that is biased by the coil springs 32. For return movement to the illustrated position, both of the first and second chambers 38 and 39 may be vent on to allow the spring 43 to move the annular piston 37 toward the position illustrated in FIG. 1.

In the illustrated embodiment, however, pressure in the first chamber 38 is varied, too.

Numeral 44 generally denotes a hydraulic circuit, numeral 46 generally denotes a spool type valve 46 within a valve chamber 45 defined within the center cylindrical bore of the insert 28, and reference numeral 47 generally denotes an actuator 47 for the valve 46.

The hydraulic circuit 44 comprises a schematically illustrated passage 51 that communicates at one end thereof with a main gallary to which oil under pressure develops owing to action of a pump 50 and a pressure regulator 49. Reference numeral 48 denotes an oil pan. The hydraulic circuit 44 also comprises passages 52 and 53 communicating with the first and second chambers 38 and 39, respectively, for connection with the valve chamber 45, and drain passage 54 for discharge of oil from the valve chamber 45 into a space designated at 55 above the cylinder head 23.

The passage 51 is composed of a vertical passage 56 extending through the cylinder head 33, a radial bore 57 of the camshaft 22, an annular clearance 58 around the bolt 25, a passage 59 extending through the stub shaft 24, a circumferential groove 60 of the insert 28 and a port 61 of the insert 28. Connection between the port 61 and the passage 59 is established by the circumferential groove 60.

The before-mentioned passages 52 and 53 are axially spaced and disposed angularly spaded from the port 61 with respect to the axis of rotation of the camshaft 22. The first passage 52 includes a port 62 stub shaft 24 connected via a first circumferential groove to the port 62. The second passage 53 is composed of a port 64 and a passage 65 of the stub shaft 24 connected via a second circumferential groove to the port 64.

The drain passage 54 is composed of a drain port 67 and a vent passage 69 of the stub shaft 24. The drain port 67 communicates with a drain chamber 66 in which the head of the bolt 25 is disposed. The vent passage 69 communicates at one end with the drain chamber 66 and at the opposite end with a groove 68 on the inner periphery of the retainer 27. This groove 68 opens to the space 55 above the cylinder head 23. A discharge port 71 of the spool 46 establishes communication between that portion of the valve chamber 25 disposed between the end plug **26*b* and the spool 46 and the axial central bore 70**.

The spool 46 has axially spaced first and second lands 72 and 73 with an annular space 74 defined between the lands 72 and 73. This annular space 74 is always in communication with the port 61. The spool 46 is formed with an axial central bore 70 having an axial opening opposed to the drain port 67. A return spring 75 within the axial central bore 70 acts at one end on the spool 46 and at the other end on the partition **28*b* of the insert 28, biasing the spool 46 toward an end plug or cap 26*b* of the front cover 26. An internal plunger 46*a* extends forwardly from the spool 46 through a central opening of the plug 26*b***.

The actuator 47 is of the solenoid operated proportional type which can position its rod 83 in response to the duty of its solenoid in response to a control signal developed by a controller 77. The rod 83 abuts at its leading end the front end of the plunger **46*a* of the spool 46. The actuator 47 includes a casing 79 fixedly attached to a belt cover 78 on the front end of the engine, a solenoid 80 within the casing 79, a stationary core 81, and a positionable core 83 fixedly coupled with the rod 83**.

The controller 77 inputs information from a crank angle sensor 84, an air-flow meter, not shown, and a speed sensor 85 arranged to sense speed of the camshaft 22 and outputs the control signal.

For ease of description, it is assumed that in the position as illustrated in FIG. 1, the camshaft 22 is maintained by the front and rear gears 30 and 31 in a retarded phase relation with the sprocket 21 for operation of the actuated inatake valves under desired retarded timing conditions. In this position, if desired, the camshaft 22 may be maintained in an advanced phase relation with the sprocket 21 for operation of the actuated engine exhaust valves under desired advanced timing conditions (see FIG. 5).

In operation of the variable camshaft phase changing device just described, when the spool 46 assumes a closed position as illustrated in FIG. 1, the lands 72 and 73 cover the associated ports 62 and 64.

When the engine operating conditions call for advanced valve timing of the intake valves, the spool 46 moves from the illustrated position to the right viewing in FIG. 1, the land 72 uncovers the port 62, allowing discharge of oil from the first chamber 38 through the portion the valve chamber 45, discharge port 71, axial central bore 70, drain port 67, drain chamber 66, vent passage 69 and groove 68, and the land 73 uncovers the port 64, allowing supply of oil to the second chamber 39 through the passage 56, radial bore 57, clearance 58, passage 59, groove 60, port 61 and space 74 between the lands 72 and 73. This causes oil pressure in the second 20 chamber 39 to increase and oil pressure in the first chamber 38 to decrease. Thus, the oil pressure in the second chamber 39 moves the annular piston 37 against the bias of the assist spring 43 to the left viewing in FIG. 1, pulling the rear gear 31 via engagement of the heads **42*b* of the pins 42 with the bottom walls of the recesses 36 of the rear gear 31 and then pulling the rear gear 30 that is biased away from the front gear 31 and towards the annular piston 37. Because of the opposite helix angles of the external, and internal helical splines 24*b* and 21*c*, the forward motion of the front and rear gears 30 and 31 vary the phase angle of the camshaft 22** relative to the sprocket so that the timing of the associated intake valves is likewise varied.

When the desired timing is accomplished, the actuator 47 allows the spool 46 to return toward the position as illustrated in FIG. 1 to establish such a pressure relation between the chambers 38 and 39 as to hold the annular piston 37.

A return toward the retarded timing of the intake valves when called for is accomplished by decreasing the electromagnetic force of the solenoid 80 to allow the return spring 75 to move the spool 73 to the left, viewing in FIG. 1 beyond the position as illustrated In FIG. 1. This movement of the spool 73 causes the lands 72 and 73 to uncover the associated ports 62 and 64, respectively, to allow supply of oil to the first chamber 38 and discharge of oil from the second chamber 39. Owing to the force of the assist spring 43 and oil pressure in the first chamber 38, the annular piston 37 moves in a return direction towards the retainer 27, pushing the front gear 30 and then pushing the front gear 31 that is biased by the coil springs 32.

In addition to their phase-changing function, the front and rear gears 30 and 31 are also means through which all torque is transferred from the sprocket 21 to the camshaft 22 and vice versa via their inner arm outer splines **33*a*, 34*a* and 33*b*, 34*b* and the mating external and internal helical splines 24*b*, 21*c*. The annular piston 37 does not constitute the means for transferring the torque. The mis-alignment of the front and rear gears 30, 31 and their biasing one apart from another by the coil springs 32 takes up any clearance lash in the spline connections (see FIG. 3**).

Figure 4:
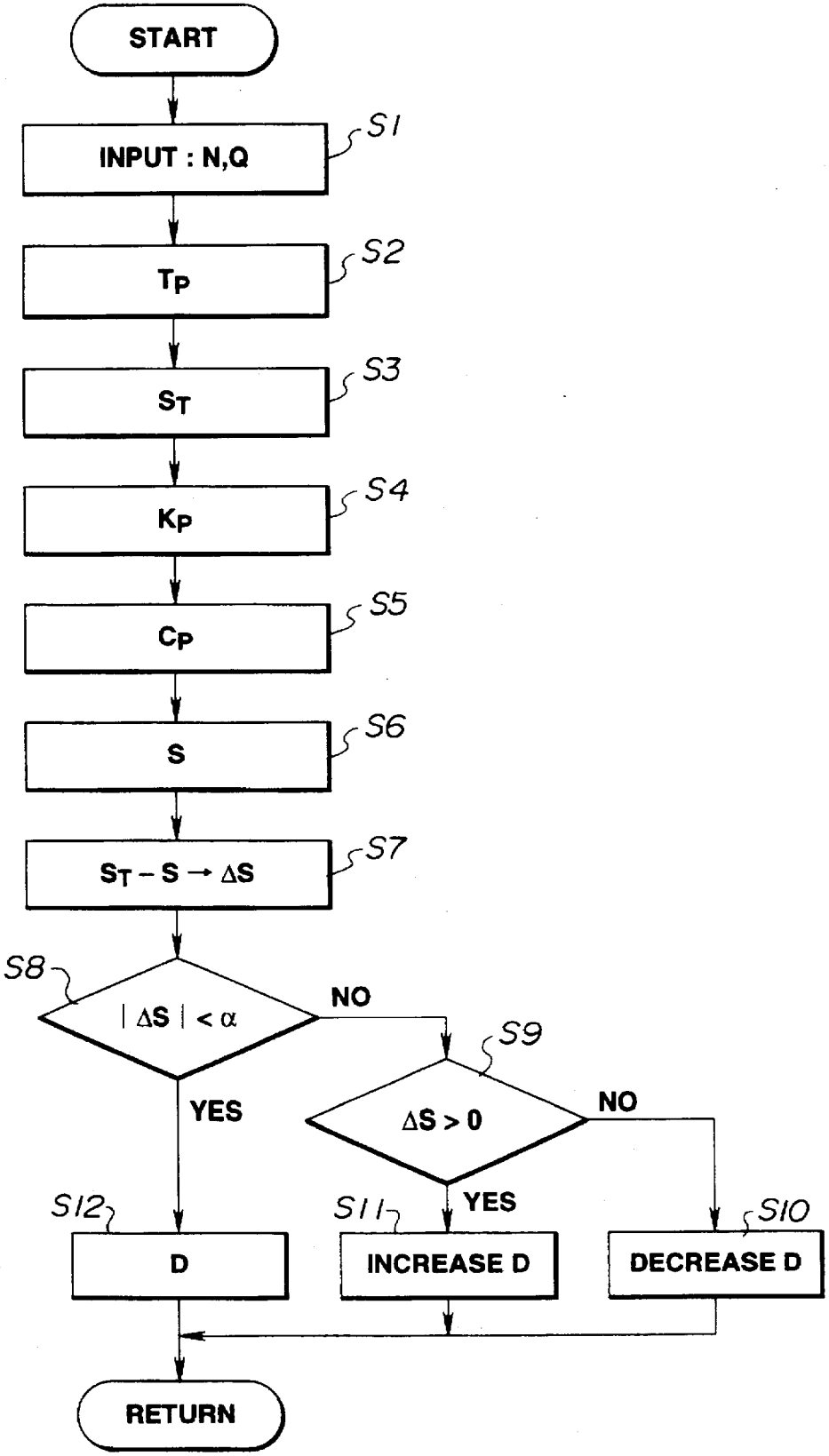
FIG. 4 is a flow chart of a control routine for the camshaft phase changing device.

The flow chart in FIG. 4 shows a preferred implementation of a control routine. At box S1, the controller 77 inputs information as to crankshaft speed N, airflow rate Q and throttle opening degree $\theta_T$ from outputs of the crankshaft angle sensor 84, airflow meter and throttle opening degree sensor. At box S2, the controller 77 computes habit fuel amount $T_P$ for fuel injection based on the input information. At box S3, the controller 77 performs a table look-up operation of a map based on N and $T_P$ to determine a target value $S_T$ in advance of the valve timing. At box S4, the controller 77 inputs information of crankshaft angle $K_P$. At the next box S5, the controller 77 inputs information of camshaft speed $C_P$ from output of the speed sensor 85. At box S6, the controller 77 computes actual advance of the camshaft 22 relative to the sprocket 21 based on $K_P$ and $C_P$. At box S7, the controller 77 computes a deviation delta S by subtracting S from $S_T$. At box S8, the controller 77 determines whether the absolute value of the delta S is less than a predetermined value alpha or not. If this is the case, the controller 77 leaves duty D of the solenoid 80 unaltered at box S12. If the interrogation at box S8 is negative, the controller 77 determines whether the delta S is positive or not at box S9. If this is the case, the controller 77 increases the duty D of the solenoid 80 at box S11. If the interrogation at box S9 is negative, i.e., delta S being negative, the controller 77 decreases the duty D of the solenoid 80 at box S10.

From this description of the flow chart in conjunction with the previous description of the motion of the spool 46, it will be readily understood to those skilled in the art that the timing of the camshaft 22 relative to the sprocket 21 is maintained at the target value $S_T$.

During the stroke of the annular piston 37, the separation of the front end gears 30 and 31 is decreased by compressing the coil springs 32 and thus the lash take-up force is reduced. Thus, the friction that opposes the motion of the front and rear gears 30 and 31 is reduced.

The pins 42 associate the annular piston and front and rear gears 30 and 31, resulting simplification of the structure and reduction in number of the component parts.

The relative angular displacement of the camshaft 22 to the sprocket 11 is determined by relationship in position between the heads 42*b* of the pins 42 and bottom walls of the recesses 36 of the rear gear 31. Thus, accuracy of the system is not influenced by narrowing of a gap S (see FIG. 3) between the annular piston 37 and the front gear 30. The gap S decreases owing to the action of the coil springs 32 as the inner and outer teeth 33*a*, 34*a*, 33*b*, 34*b* change in their dimension after a long use.

In operation, the sprocket 21 turns in a downward direction as indicated by an arrow A viewing in FIG. 3 and the interior teeth 21*c* biases the outer teeth 33*b* and thus the front gear 30 to the right, thus compressing the coil spring 32. Thus, the coil springs 32 bias the rear gear 31 to keep the bottom walls of the recesses 36 in contact with the heads 42*b* of the pins 42.

Figure 5:
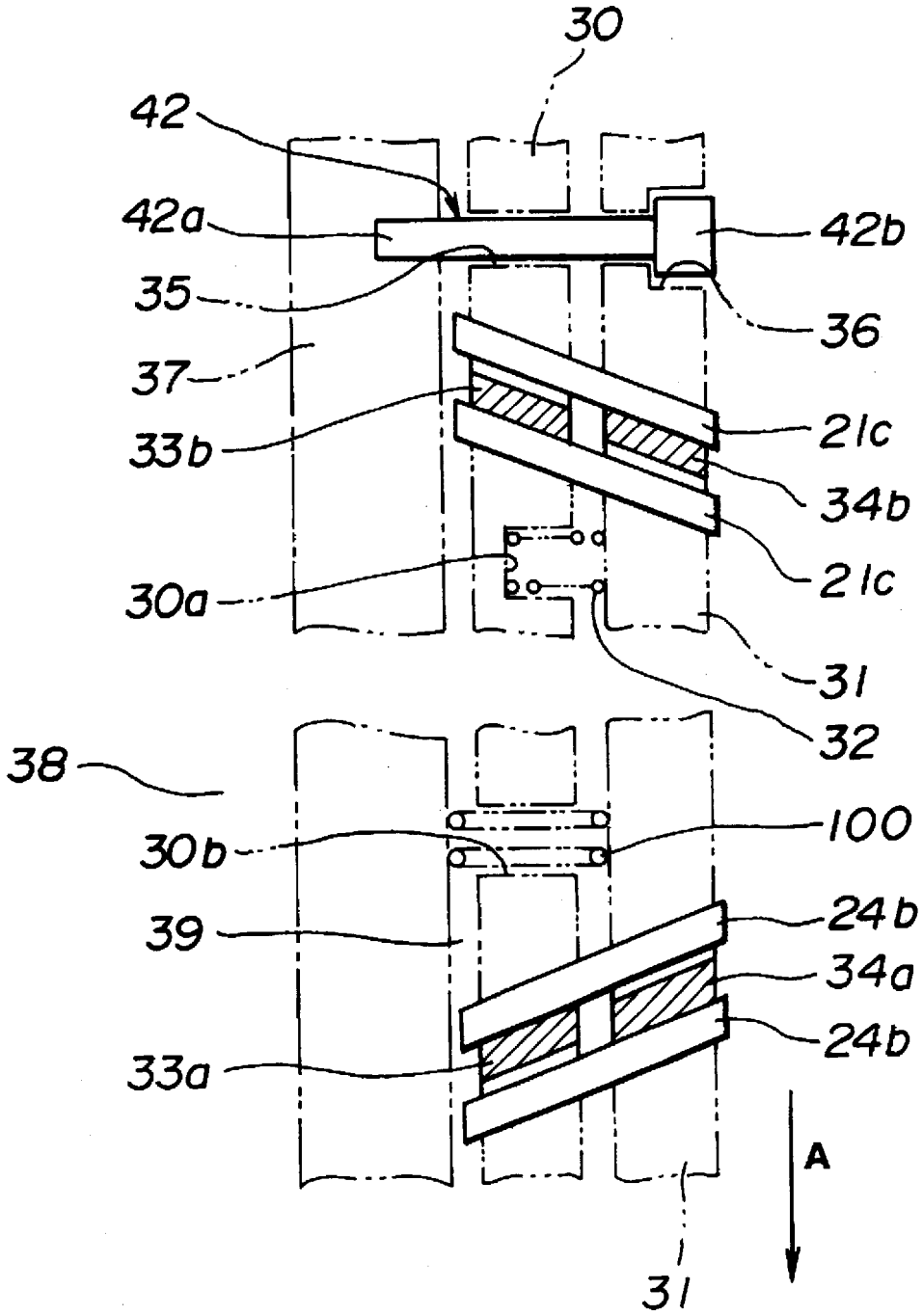
FIG. 5 is a similar view to FIG. 3 illustrating a second embodiment according to the present invention.

Referring to the second embodiment shown in FIG. 5, this embodiment is substantially the came as the first embodiment except that a relationship of helix angles with direction of rotation A of a sprocket 21 is different and buffer coil springs 100 are disposed in holes 30*b* of a front gear 30 and between an annular piston 37 and a rear gear 31. The provision of the buffer springs 100 is to suppress movement of the rear gear 31 toward the annular piston 37 when a stub shaft 24 is subject to torque in a direction opposite to the direction A of rotation of a sprocket 21 owing to the valve springs of the actuated engine valves by a camshaft 22. Torque in the opposite direction applied on the stub shaft 24 acts via external helical spline 24*b* thereof and inner teeth 34*a* to the rear gear 31, urging the rear gear 31 toward the annular piston 37.

Figure 6:
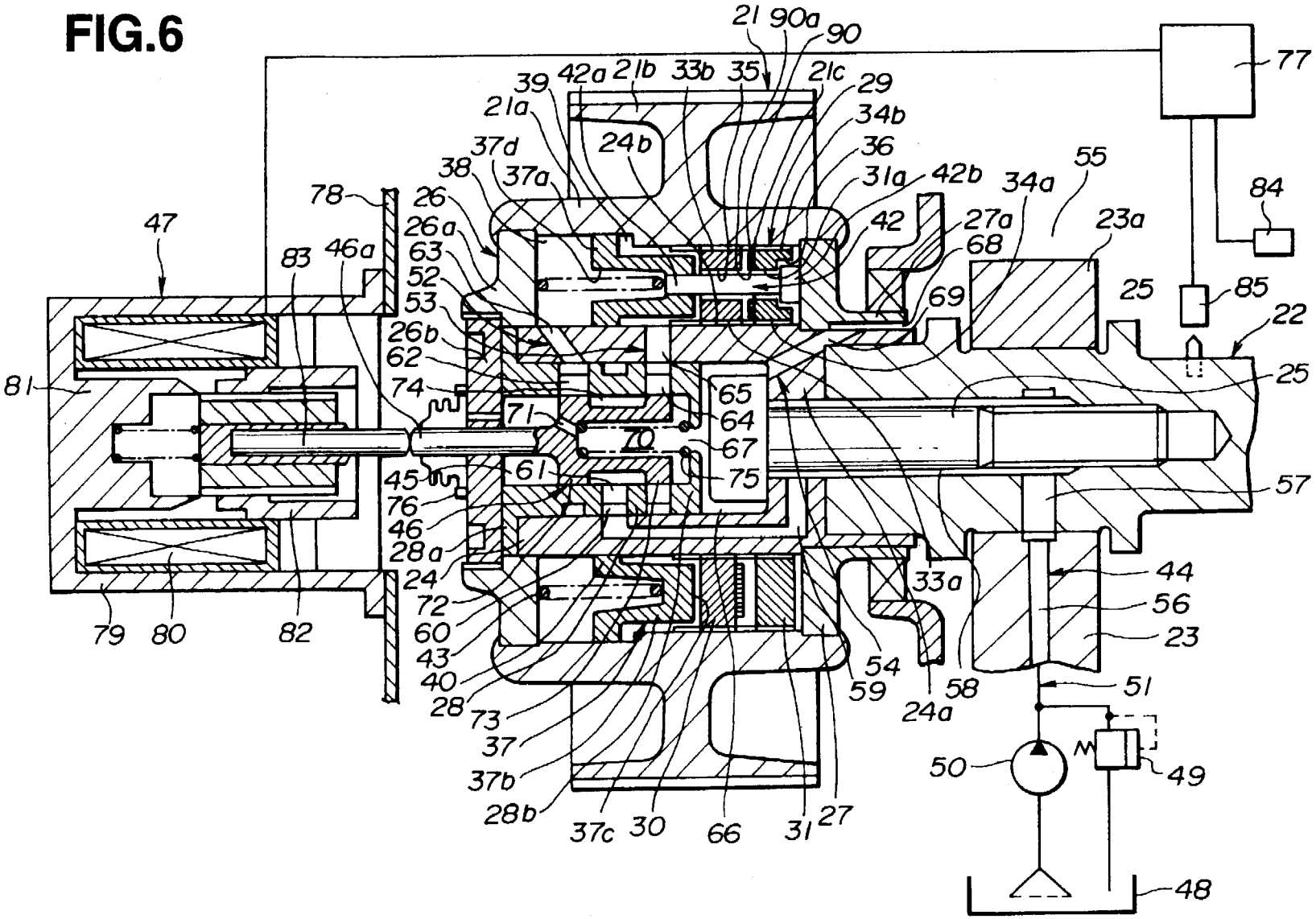
FIG. 6 is a similar view to FIG. 1 illustrating a third embodiment according to the present invention.
Figure 7:
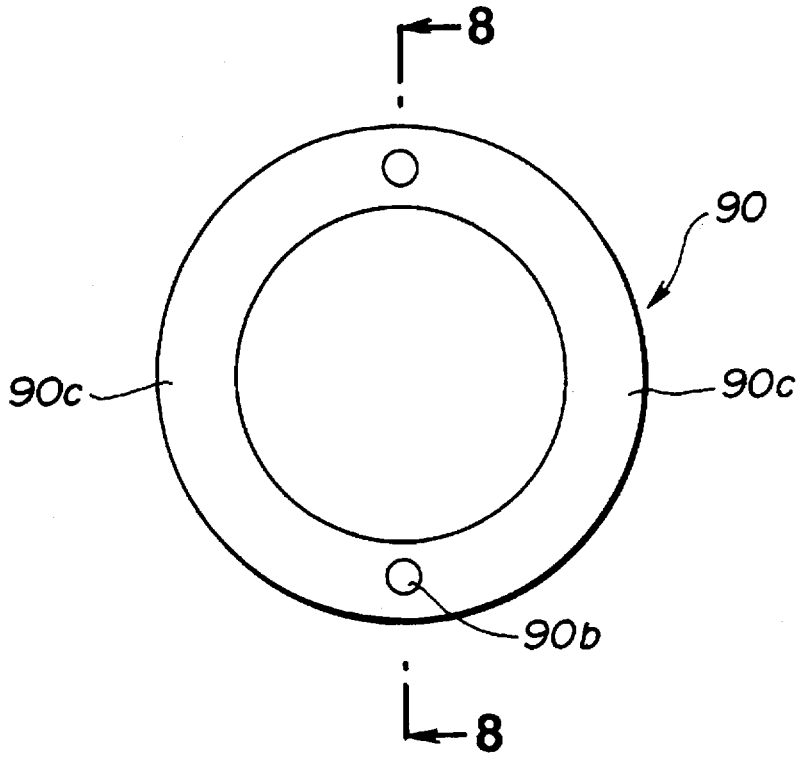
FIG. 7 is an exploded plan view of a disc spring used in FIG. 6.
Figure 8:
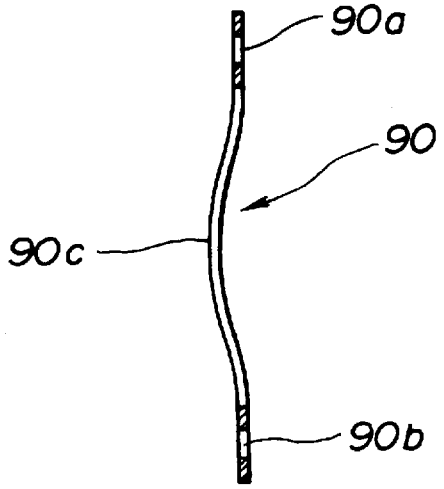
FIG. 8 is a section taken through the line 8—8 in FIG. 7.

FIG. 6 illustrates the third embodiment of the present invention. The third embodiment is substantially the same as the first embodiment except that a disc spring 90 has replaced the coil springs 32 and the recesses 30*a* in the front gear 30. As shown in FIGS. 7 and 8, the disc spring 90 is formed with two diametrically opposed holes 90*a* through which pins 42 extend and has portions 90*c* between the holes 90*a* curved as best seen in FIG. 8.

In the previously described embodiments, the coil springs 32 and the disc spring 90 have been used as biasing means. The biasing means, if desired, may be in the form of any other appropriate resilient member.

What is claimed is:

1. A variable camshaft phase changing device for an internal combustion engine having a camshaft rotatable about a camshaft axis, comprising:

co-axial drive and driven members, said driven member being securable to the camshaft for rotation therewith about an axis, said drive and driven members having an internal helical spline and an external helical spline, respectively, that are facing each other and have opposite helix angles;

two axially-spaced annular gears disposed between said drive and driven members, each of said annular gears having inner and outer helical splines, said inner helical splines of said annular gears mating with said external helical spline of said driven member, said outer helical splines of said annular gears mating with said internal helical spline of said drive member;

a resilient member biasing said annular gears one apart from the other for lash take-up, whereby said outer splines of said annular gears and said inner splines of said annular gears are aligned so that said outer splines of said annular gears engage opposite sides of said internal spline of said drive member and said inner splines of said annular gears engage opposite sides of said external spline of said driven member;

an annular piston axially moving said annular gears in one direction and in a return direction opposite to said one direction to vary the phase relationship between said drive and driven members;

said annular piston having a plurality of pins passing through one of said annular gears to the other of said annular gears;

said plurality of pins having heads arranged in driving relation with the other of said annular gears for transmitting motion of said plurality of pins to the other of said annular gears in said one direction as said annular piston moves in said one direction; and said annular piston being movable in said return direction to move the one of said annular gears in said return direction as said annular piston moves in said return direction.

2. A variable camshaft phase changing device as claimed in claim 1, wherein said biasing means include a plurality of coil springs compressed between said annular gears.

3. A variable camshaft phase changing device as claimed in claim 2, wherein the one of said annular gears has recesses receiving said plurality of coil springs, respectively.

4. A variable camshaft phase changing device as claimed in claim 3, wherein the one of said annular gears has bores formed therethrough which slidably receive said pins, respectively.

5. A variable camshaft phase changing device as claimed in claim 4, wherein said recesses and said bores are arranged angularly spaced about said axis of rotation.

6. A variable camshaft phase changing device as claimed in claim 1, wherein buffer springs are disposed between said annular piston and the other of said annular gears.

7. A variable camshaft phase chaning device as claimed in claim 6, wherein the one of said annular gears has formed therethrough holes which receive said buffer springs, respectively.

8. A variable camshaft phase changing device as claimed in claim 1, wherein said biasing means include a disc spring disposed between said annular gears.

9. A variable camshaft phase changing device for an internal combustion engine having a camshaft rotatable about an axis, the device comprising:

a driven member having an external helical spline, and securable to the camshaft for rotation with the camshaft about the axis;

a drive member coaxial with the driven member and having an internal helical spline, wherein the internal helical spline and the external helical spline have opposite helix angles;

first and second axially-spaced annular gears disposed between the drive member and the driven member, each of the annular gears having an inner helical spline and an outer helical spline, the inner helical spline mating with the external helical spline, and the outer helical spline mating with the internal helical spline;

a resilient member biasing the first and second annular gears away from each other;

an annular piston axially moving the annular gears in a first direction and in a second direction opposite to the first direction;

the annular piston having a plurality of pins passing through the first annular gear to the second annular gear, the pins having heads for transmitting motion of the annular piston to the second annular gear in the first direction; and the annular piston moving the first annular gear in the second direction.

10. A variable camshaft phase changing device for an internal combustion engine having a camshaft rotatable about an axis, the device comprising:

a sprocket having an internal helical spline;

a stub shaft securable to the camshaft for rotation therewith about the axis, the stub shaft having an external helical spline facing the internal helical spline, the external and internal helical splines having opposite helix angles;

first and second axially-spaced annular gears disposed between the sprocket and the stub shaft, each of the first and second annular gears having inner and outer helical splines, the inner helical splines mating with the external helical spline of the stub shaft, and the outer helical splines of the first and second annular gears mating with the internal helical spline of the sprocket;

a resilient member disposed between the first and second annular gears to bias the first and second annular gears apart from each other for lash take-up, whereby the outer splines of the first and second annular gears and the inner splines of the first and second annular gears are aligned so that the outer splines of the first and second annular gears engage opposite sides of the internal spline of the sprocket and the inner splines of the annular gears engage opposite sides of the external spline of the stub shaft;

an annular piston axially moving the first and second annular gears in a first direction and in a second direction opposite to the first direction to vary a phase relationship between the sprocket and the stub shaft;

the annular piston having a plurality of pins passing through the first annular gear to the second annular gear, the plurality of pins having heads arranged with the second annular gear and transmitting motion of the plurality of pins to the second annular gear in the first direction as the annular piston moves in the first direction, causing the second annular gear to compress the resilient member and bias the first annular gear to move in the first direction; and the annular piston moving the first annular gear in the second direction as the annular piston moves in the second direction, causing the first annular gear to compress the resilient member and bias the second annular gear to move in the second direction.

11. A variable camshaft phase changing device as claimed in claim 10, wherein the resilient member comprises a coil spring.

12. A variable camshaft phase changing device as claimed in claim 10, wherein the resilient member comprises a disc spring.

* * * * *